US011527183B2

(12) United States Patent
Lee et al.

(10) Patent No.: US 11,527,183 B2
(45) Date of Patent: Dec. 13, 2022

(54) SIGN HAVING THREE-DIMENSIONAL EFFECT, METHOD FOR MANUFACTURING SAME, ANTI-SKID PAVEMENT ASSEMBLY, AND STICKER

(71) Applicant: CGS KOREA CO., LTD., Chungcheongnam-do (KR)

(72) Inventors: Eun Ok Lee, Goyang-si (KR); Doo Sub Sim, Chungcheongnamdo (KR); Ji Hyun Park, Seosan-si (KR)

(73) Assignee: CGS KOREA CO., LTD., Chungcheongnam-do (KR)

( * ) Notice: Subject to any disclaimer, the term of this patent is extended or adjusted under 35 U.S.C. 154(b) by 939 days.

(21) Appl. No.: 16/317,566

(22) PCT Filed: Mar. 29, 2017

(86) PCT No.: PCT/KR2017/003387
§ 371 (c)(1),
(2) Date: Jan. 14, 2019

(87) PCT Pub. No.: WO2018/012712
PCT Pub. Date: Jan. 18, 2018

(65) Prior Publication Data

US 2019/0287436 A1 Sep. 19, 2019

(30) Foreign Application Priority Data

Jul. 14, 2016 (KR) ..... 10-2016-0089064

(51) Int. Cl.
*G09F 19/12* (2006.01)
*E01F 9/512* (2016.01)
(Continued)

(52) U.S. Cl.
CPC ..... *G09F 19/12* (2013.01); *E01C 11/24* (2013.01); *E01F 9/512* (2016.02); *G09F 3/02* (2013.01);
(Continued)

(58) Field of Classification Search
CPC . G09F 19/12; G09F 3/02; G09F 19/22; G09F 2019/223; G09F 19/14; G09F 19/18; E01C 11/24; E01F 9/512
See application file for complete search history.

(56) References Cited

U.S. PATENT DOCUMENTS

2004/0035030 A1* 2/2004 Sondergaard ..... G09F 19/18 40/453
2012/0167422 A1* 7/2012 Huang ..... G09F 19/22 40/542
(Continued)

FOREIGN PATENT DOCUMENTS

EP 1944414 A1 * 7/2008 ..... E01F 9/529
JP 09-041332 A 2/1997
(Continued)

OTHER PUBLICATIONS

Dolasia, Meera, The 3-D Zebra Crossings That Are Making India's Roads Safer for Pedestrians, Jun. 2, 2016, https://www.dogonews.com/2016/6/2/the-3-d-zebra-crossings-that-are-making-indias-roads-safer-for-pedestrians (Year: 2016).*
(Continued)

*Primary Examiner* — Cassandra Davis
(74) *Attorney, Agent, or Firm* — Revolution IP, PLLC

(57) ABSTRACT

A manufacturing method of a 3D stereoeffect sign includes designing a figure or a character having specific information, giving a volume to the figure or the character by providing one or more vanishing points, setting a projection height of the figure or the character having the volume which is
(Continued)

projected to the eyes of a viewer which is located at a reference distance, setting a printed length of the figure or the character having the volume to correspond to the projection height, setting a printed width of the figure or the character having the volume, and adjusting the length and the width of the figure or the character having the volume proportionally to correspond to the printed length and the printed width.

4 Claims, 13 Drawing Sheets

(51) Int. Cl.
*E01C 11/24* (2006.01)
*G09F 3/02* (2006.01)
*G09F 19/22* (2006.01)

(52) U.S. Cl.
CPC ..... *G09F 19/22* (2013.01); *G09F 2019/223* (2013.01)

(56) References Cited

U.S. PATENT DOCUMENTS

2015/0143727 A1* 5/2015 Kim ..... E01F 9/50
40/427
2019/0287436 A1* 9/2019 Lee ..... E01C 11/24

FOREIGN PATENT DOCUMENTS

| | | | | |
|---|---|---|---|---|
| JP | 2005-246728 | A | 9/2005 | |
| KR | 20-2006-0000168 | U | 12/2006 | |
| KR | 10-1251370 | B1 | 4/2013 | |
| KR | 10-1610601 | B1 | 4/2016 | |
| KR | 101610601 | B1 * | 4/2016 | |
| WO | WO-2010015078 | A1 * | 2/2010 | ..... G09F 21/04 |

OTHER PUBLICATIONS

International Search Report for PCT/KR2017/003387 dated Jul. 10, 2017 from Korean Intellectual Property Office.

* cited by examiner (a)

(b)

SIGN HAVING THREE-DIMENSIONAL EFFECT, METHOD FOR MANUFACTURING SAME, ANTI-SKID PAVEMENT ASSEMBLY, AND STICKER

TECHNICAL FIELD

The present invention relates to a sign providing specific information to a viewer, and more particularly, to a 3D stereoeffect sign which is stereoscopically projected to the eyes of the viewer to improve visibility.

BACKGROUND ART

There is a lot of information on the road. Such information serves to guide specific information to a viewer or provide warnings to demand an action. In general, a sign is installed to be vertical to the road so that the instruction content of the sign is clearly read to the viewer.

However, in a tunnel section, a narrow passage, a soundproof wall installation section of the expressway, and the like which are the lack of free space as environments difficult to set up the signs, an extra space is required to install the signs to be vertical to the road and thus separate construction costs are added.

In addition, since a protruding object provided on the road is an element which has a risk of collision with moving cars or viewers, it is preferable that the protruding object is not provided on the road as much as possible.

As described above, in environments where it is difficult to set up signs due to a space problem, a risk of collision, and the like, the sign is installed in an area inevitably deviating from a sight range of the viewer, and thus the sign is not easily recognized by the viewer.

Therefore, in order to solve such problems, there is a need for a method for minimizing a space required for installing the sign, reducing the construction costs, and increasing the visibility.

DISCLOSURE

Technical Problem

In order to solve the problems in the related art, an object of the present invention is to provide a 3D stereoeffect sign which is stereoscopically projected to the eyes of a viewer to increase visibility.

Another object of the present invention is to provide a 3D stereoeffect sign which is safe by removing a protruding structure on a narrow road.

Yet another object of the present invention is to provide a 3D stereoeffect sign which is safe by minimizing a height of a protrusion of a protruding structure on a narrow road.

Further, still another object of the present invention is to provide a manufacturing method of a 3D stereoeffect sign.

Still yet another object of the present invention is to provide a non-slip packaging assembly having a 3D stereoeffect sign.

Still yet another object of the present invention is to provide a sticker having a 3D stereoeffect sign.

The objects of the present invention are not limited to the aforementioned objects, and other objects, which are not mentioned above, will be apparent to a person having ordinary skill in the art from the following description.

Technical Solution

In order to achieve the above object, an aspect of the present invention provides a manufacturing method of a 3D stereo effect sign, including: designing a figure or a character having specific information; giving a volume to the figure or the character by providing one or more vanishing points; setting a projection height of the figure or the character having the volume, which is projected to the eyes of a viewer which is located at a reference distance; setting a printed length of the figure or the character having the volume to correspond to the projection height; setting a printed width of the figure or the character having the volume; and adjusting the length and the width of the figure or the character having the volume proportionally to correspond to the printed length and the printed width.

The 3D stereoeffect sign may be provided on an oblique line of the sight of the viewer and the vanishing points may be provided at both sides with respect to the oblique line, respectively.

The volume given to the figure or the character may have a color perspective.

A 3D stereoeffect sign may be manufactured by the manufacturing method of the 3D stereoeffect sign.

A non-slip packaging assembly may have the 3D stereoeffect sign.

A sticker may have the 3D stereoeffect sign.

Advantageous Effects

The manufacturing method and the 3D stereoeffect sign manufactured by the method of the present invention for solving the above problems have the following effects.

First, the sign is stereoscopically projected to the eyes of the viewer in a form of vertically protruding on the road, thereby increasing visibility.

Second, a risk of collision is removed by removing a protruding structure on a road in which an available space is narrow and thus it is safe in passage.

Third, the sign is provided in an area with high flood populations such as an entrance at an art museum or a café to attract interest to the passing viewer and raise awareness.

The effects of the present invention are not limited to the aforementioned effects, and other effects, which are not mentioned above, will be apparent to a person having ordinary skill in the art from the description of claims.

MODES OF THE INVENTION

Figure 1:
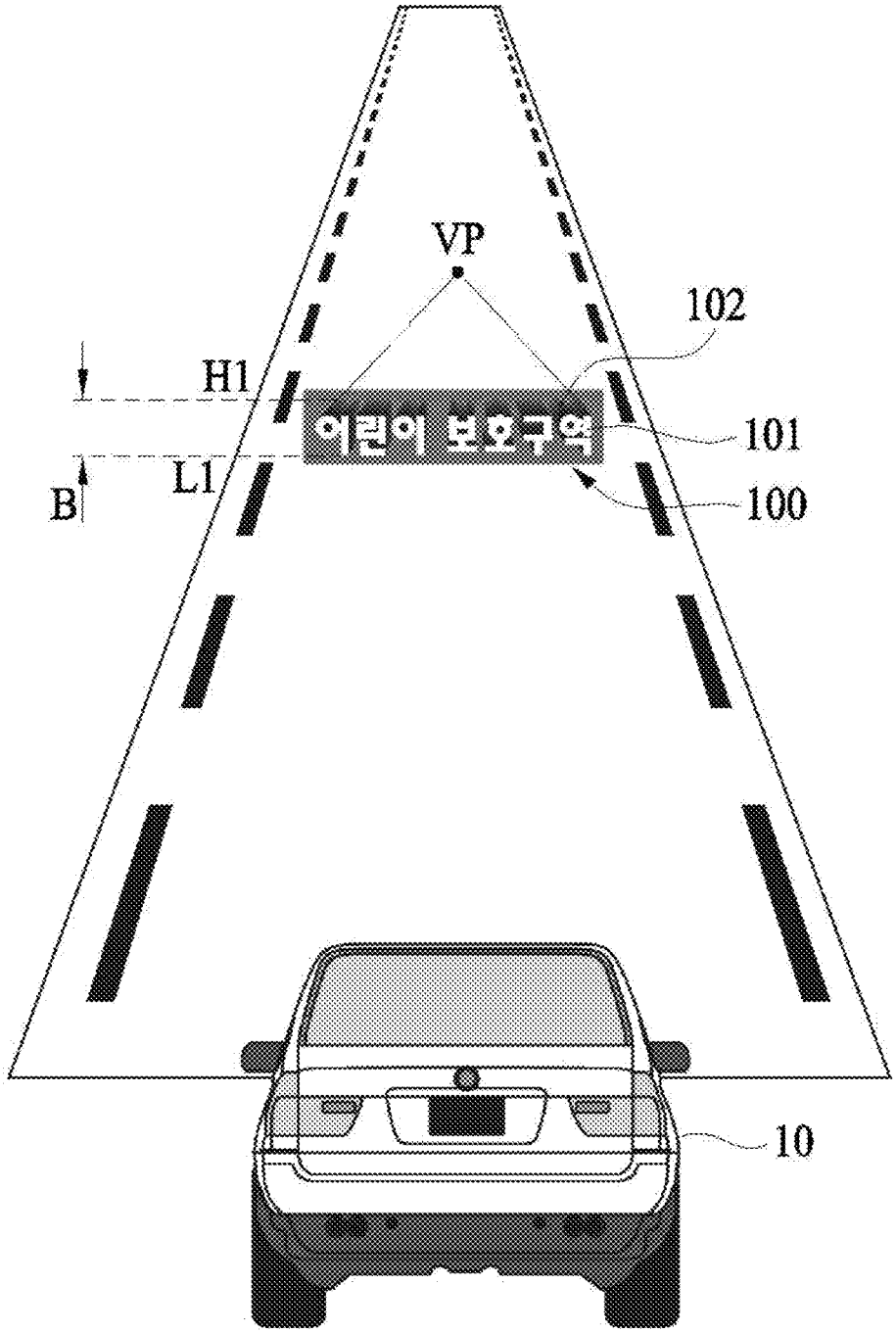
FIG. 1 is a diagram illustrating a visual effect of a 3D stereoeffect sign 100 according to a first embodiment of the present invention.

Hereinafter, preferred embodiments of the present invention in which the above objects can be specifically implemented will be described in detail with reference to the accompanying drawings. When describing the embodiments, like names and reference numerals designate like components and as a result, the additional description will be omitted.

A visual effect of a 3D stereoeffect sign 100 according to a first embodiment of the present invention will be described below with reference to FIG. 1.

The 3D stereoeffect sign 100 according to the first embodiment of the present invention is provided on the surface of a road, a wall of a road section, a ceiling of a tunnel section, and the like and provides specific information to a viewer 10 (a driver) entering the road in a section having the sign 100 as figures or characters. The specific information may be road names, various guidance statements such as car guidance of key points, or warnings such as speed warning, drowsy driving warning, safety distance establishment warning, and a no-smoking sign, and may be information on electors provided in election as a poster.

Figure 4:
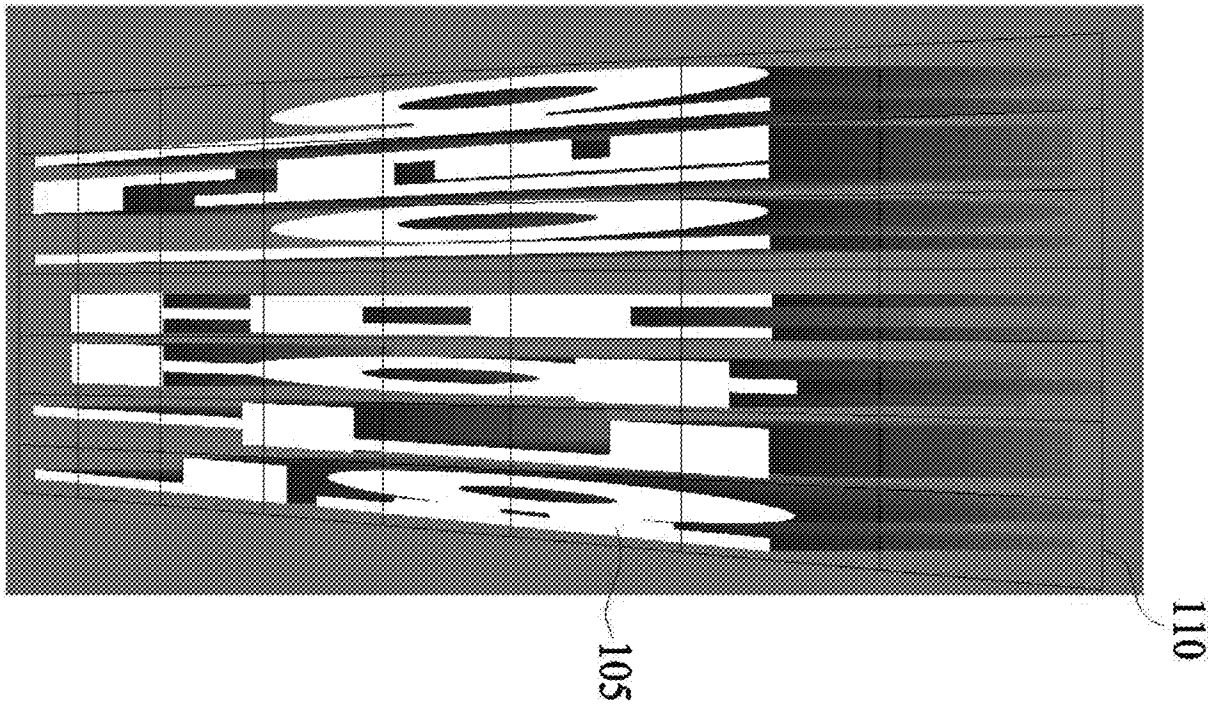
FIG. 4 is a plan view illustrating an example of the 3D stereoeffect sign 100 according to the first embodiment of the present invention.

In order to manufacture the 3D stereoeffect sign 100 according to the first embodiment of the present invention, designing a character 101 having the specific information is included. The specific information according to the first embodiment is the character 101, but the specific information may be a figure other than the character 101 (see a second embodiment of FIG. 5). The designed character 101 has a shape which is projected to the eyes of the viewer 101 and a shape 105 (see FIG. 4) of an actually printed character is a shape adjusted to be proportional to a virtual grid 110 to be described below.

In addition, a volume 102 is given to the character 101. The volume 101 allows the designed character 101 to be felt as a 3D shape which is a lump having a volume, not a planar shape 2D.

In order to give the volume 102, vanishing points vp are set at a specific location. In bird's eye views for art and building facilities and the like, a perspective drawing method is used for expressing a 3D on the 2D plane, and the vanishing points of one point, two points, three points or more have been used. In the first embodiment of the present invention, one vanishing point vp is expressed, and the vanishing points may be two or more according to an embodiment of the present invention (see a third embodiment of FIG. 7).

The volume 102 is given to the character 101 using the set vanishing points vp. Since the first embodiment of the present invention has one vanishing point vp, one-point perspective is applied. The volume 102 gives a stereoscopic effect to the 3D stereoeffect sign 100 to increase visibility. Further, since the viewer 10 recognizes that the sign 100 protrudes stereoscopically, the viewer 10, which is a driver, reduces the speed of the vehicle during driving when the sign is provided on the bottom of the road.

The volume 102 given to the figure or character further includes a color perspective. As the color perspective is close to the vanishing point vp, the chroma is lowered. The color perspective further gives a stereoscopic effect to the volume 102 to increase the visibility.

In addition, a projection height B from an uppermost point H1 to a lowermost point L1 of the sign which is projected to the eyes of the viewer is set at a height A where the eyes of the viewer are located. In the first embodiment of the present invention, the projection height B is the height from the uppermost point H1 to the lowermost point L1 of the sign, but if the sign is provided on the side wall, the projection height B refers to a distance from one side of the sign to the other side thereof.

Figure 2:
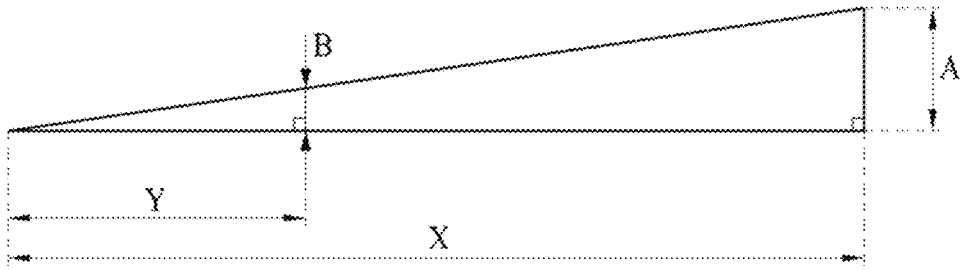
FIGS. 2 and 3 are diagrams for describing a relationship between a printed width S and a printed length Y according to a distance between a viewer 10 entering the 3D stereoeffect sign 100 and the sign 100 according to the first embodiment of the present invention.

This will be described with reference to FIG. 2. Generally, using the height A of the eyes of the viewer sitting on a driver's seat of a passenger car and a reference distance X from the sign 100 to the viewer, an actual printed length Y to be projected at the projection height B corresponding to an appropriate projection height B may be calculated according to the similar figure rule of a triangle in Equation 1. The actual printed length Y refers to a separation distance of a far side from a near side of the virtual grid 110.

$$X:A=Y:B \quad \text{[Equation 1]}$$

When it is assumed that the projection height B is 0.39 m and the height A of the eyes of the viewer on the passenger car is 1.3 m and X values are set to 15 m, 20 m, m, and 30 m, the actual printed length Y is as illustrated in Table 1 below.

TABLE 1

| Setting of X value | 15 m | 20 m | 25 m | 30 m |
|---|---|---|---|---|
| Calculation of Y value | 4.5 m | 6 m | 7.5 m | 9 m |

When it is assumed that the projection height B is 0.39 m and the height A of the eyes of the viewer on the passenger car is 1.6 m and X values are set to 15 m, 20 m, m, and 30 m, the actual printed length Y is as illustrated in Table 2 below.

TABLE 2

| Setting of X value | 15 m | 20 m | 25 m | 30 m |
|---|---|---|---|---|
| Calculation of Y value | 3.65625 m | 4.875 m | 6.09375 m | 7.3125 m |

Figure 3:
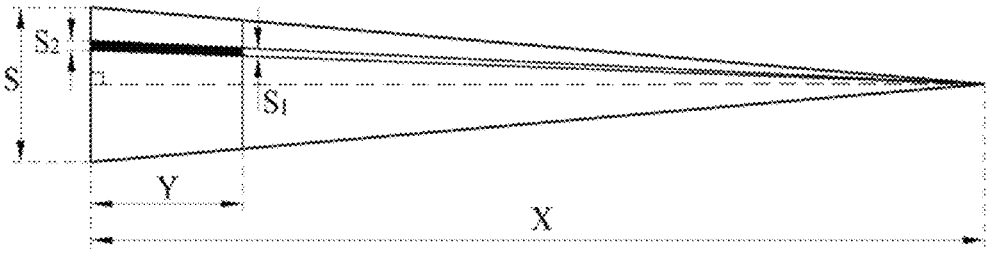

In addition, a printed width S of an optical illusion effect for vertically standing up will be described with reference to FIG. 3 and calculated according to Equation 2.

$$\tan(\theta/2)=(S/2)/X$$

$$X*\tan(\theta/2)=S/2 \quad \text{[Equation 2]}$$

That is, as X is increased, S needs to be increased. In addition, through Equation 3, when it is assumed that a printed width S1 of the near side is 10 cm when A is 1.3 m, a printed width S2 of the far side is calculated in Table 3 below. The near side is a side which is close to the viewer in the virtual grid 110 provided with a character or a figure and the far side is a side which is far away from the viewer.

$$(X-Y):S1=X:S2 \quad \text{[Equation 3]}$$

TABLE 3

| Calculation of Y value | 4.5 m | 6 m | 7.5 m | 9 m |
|---|---|---|---|---|
| Calculation of S2 value | 14.2285 cm | 14.2285 cm | 14.2285 cm | 14.2285 cm |

Like Table 3, in all cases, the S2 values are the same as each other as 14.2285 cm regardless of the Y values. Accordingly, it can be seen that a length of the far side to the near side of the character or the figure with the same area is independent to the distance between the viewer and the sign, and since the S2 value is 14.2285 cm to 10 cm, the length becomes 1.4285 times. That is, when the length of the far side to the near side is 1.4285 times, the sign looks to be vertical.

In addition, through Equation 3, when it is assumed that the printed width S1 of the near side is 10 cm when A is 1.6 m, a printed width S2 of the far side is calculated in Table 4 below.

TABLE 4

| Calculation of Y value | 3.65625 m | 4.875 m | 6.09375 m | 7.3125 m |
|---|---|---|---|---|
| Calculation of S2 value | 13.223 cm | 13.223 cm | 13.223 cm | 13.223 cm |

If S1 and S2 are 1.3223 times and have a reversed trapezoid, a 3D stereoscopic effect at a height of 0.39 m is formed when the height of the eyes of the viewer is 1.6 m.

Since the height A of the eyes of the viewer is different, according to the calculated value, in the case of 1.4285 times when A=1.3 m and 1.3223 times when A=1.6 m, a ratio of the far side and the near side varies according to the height A of the eyes of the viewer. However, if the sign is positioned at an average height of the eyes of the viewer, a perfectly vertical stereoscopic character or figure is recognized almost alike, even if it does not look like an optical illusion.

The virtual grid 110 has a reversed trapezoid. A height of the reversed trapezoid of the virtual grid becomes the printed length Y, a long side becomes the far side, and a short side becomes the near side.

The designed character 101 with the volume 102 is placed on the virtual grid 110 to increase the length proportionally according to the printed length Y to correspond to the virtual grid 110 and increase or decrease the width proportionally according to the printed widths S1 and S2. The designed character corrected to correspond to the virtual grid becomes the actual printed character 105.

A second embodiment of the present invention will be described with reference to FIGS. 5 and 6.

Figure 5:
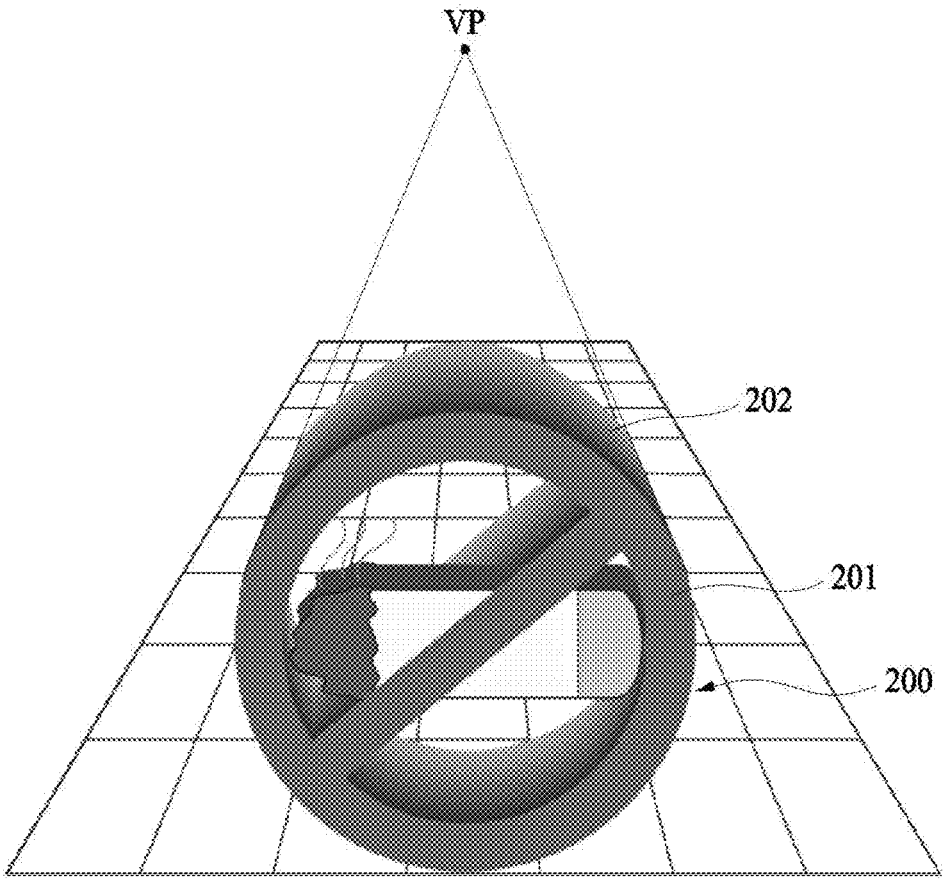
FIG. 5 is a diagram illustrating a state in which a sign 200 is projected to the eyes of a viewer according to a second embodiment of the present invention.
Figure 6:
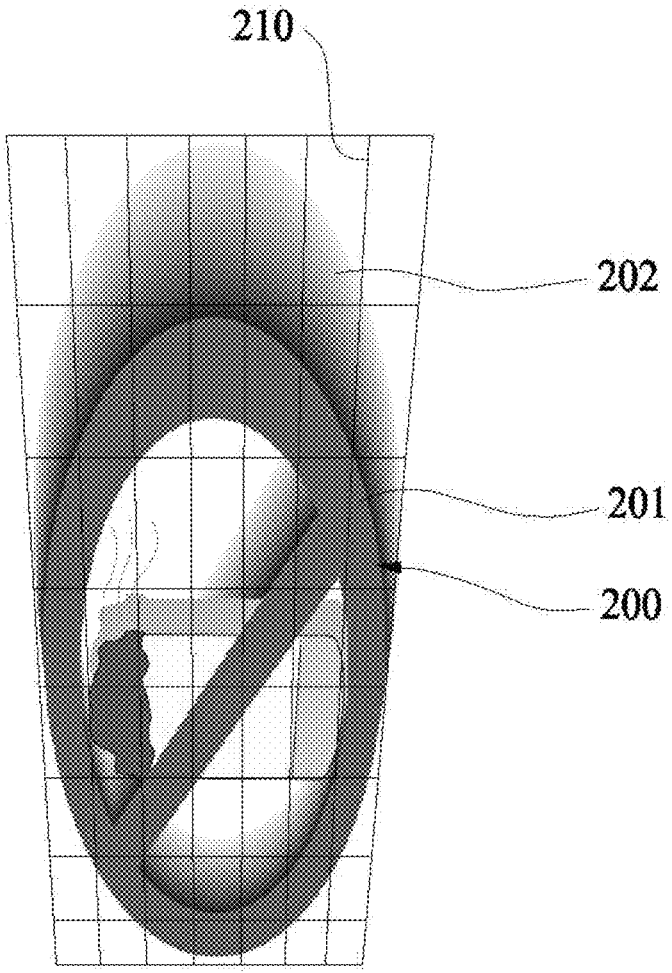
FIG. 6 is a plan view illustrating a printed example of the 3D stereoeffect sign 200 according to the second embodiment of the present invention.

FIG. 5 is a diagram illustrating a state in which a sign 200 is projected to the eyes of a viewer (not illustrated) according to a second embodiment of the present invention. As illustrated in FIG. 5, a designed FIG. 201 giving a volume 202 corresponding to a virtual grid 210 of a reversed trapezoid of FIG. 6 is corrected by increasing or decreasing proportionally a length and a width thereof so that the sign is projected to the eyes of the viewer.

A third embodiment of the present invention will be described with reference to FIGS. 7 and 8.

Figure 7:
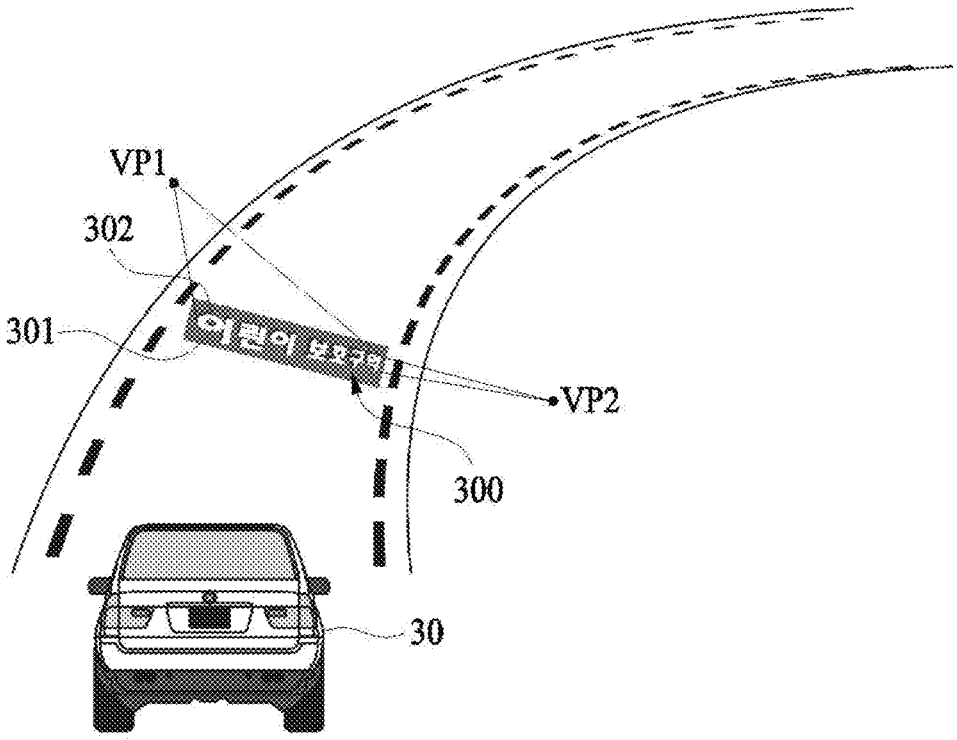
FIG. 7 is a diagram illustrating a state in which a sign 300 is projected to the eyes of a viewer 30 according to a third embodiment of the present invention.

FIG. 7 is a diagram illustrating a state in which a sign 300 is projected to the eyes of a viewer according to a third embodiment of the present invention. The sign 300 has two vanishing points. The sign 300 is provided on a diagonal line of the viewer 30.

When the viewer views an object obliquely, that is, when the viewer views the object at an oblique line, vanishing points are provided at both sides of the diagonal line and a maximum of three surfaces are visible. On the road such as a rotation section, since the road continues in an oblique direction in a progress direction of the viewer, the sign 300 is provided on the oblique line of the viewer. With respect to the sign 300 provided on the oblique line, two vanishing points vp1 and vp2 are provided at both sides at the oblique line.

When the two vanishing points vp1 and vp2 are provided, since the sign 300 exhibits a stereoscopically protruding illusion effect as seen in the oblique direction, visibility is high due to a stereoscopic effect in which directionality may be felt with respect to the progress direction, a 3D spatial effect is magnificently felt, and a perspective given by the volume 302 is felt.

Figure 8:
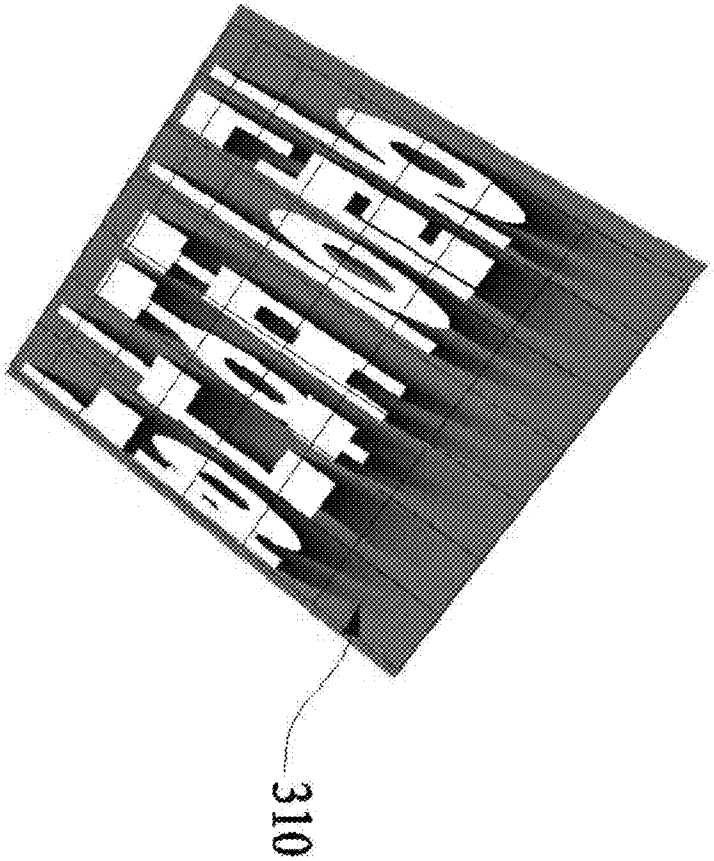
FIG. 8 is a plan view illustrating a printed example of the 3D stereoeffect sign 300 according to the third embodiment of the present invention.

As illustrated in FIG. 7, a designed FIG. 301 giving the volume 302 corresponding to a virtual grid 310 having a reversed trapezoid of FIG. 8 is corrected so that the sign is projected to the eyes of the viewer, like the method of the first embodiment.

A fourth embodiment of the present invention will be described with reference to FIGS. 9 to 11.

Figure 9:
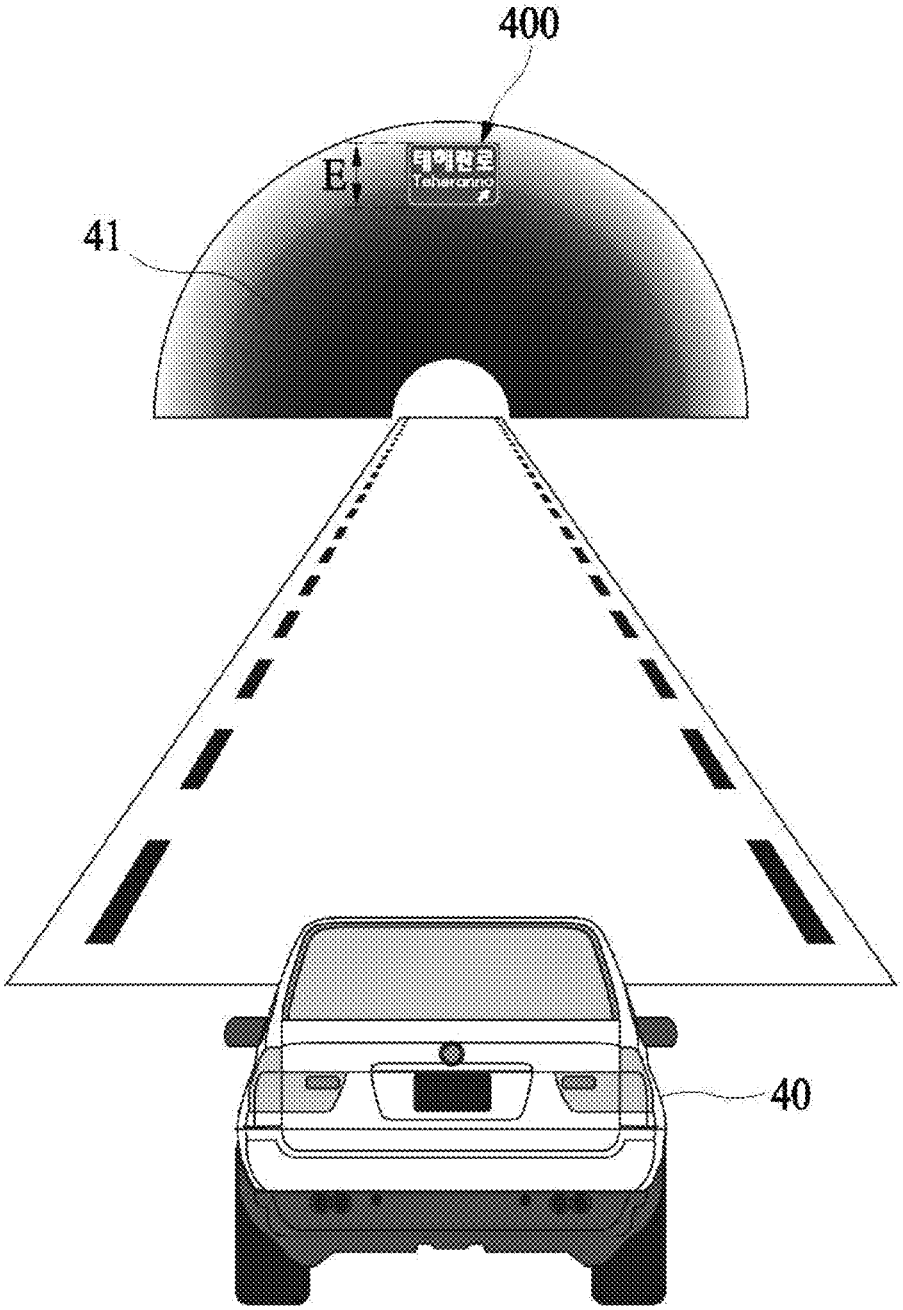
FIG. 9 is a diagram illustrating a state in which a sign 400 is projected to the eyes of a viewer 40 according to a fourth embodiment of the present invention.

FIG. 9 is a diagram illustrating a state in which a sign 400 is projected to the eyes of a viewer 40 according to a fourth embodiment of the present invention. The sign 400 according to the fourth embodiment of the present invention is attached and provided on a ceiling surface of a tunnel 41 section.

Since the 3D stereoeffect sign 400 is provided on a ceiling section of the tunnel, a narrow road, a lower surface of a pedestrian overpass, and the like, a separate surplus space is not required to reduce the construction costs, and a vertically protruding sign is not provided thereby to provide a wider road space.

Figure 10:
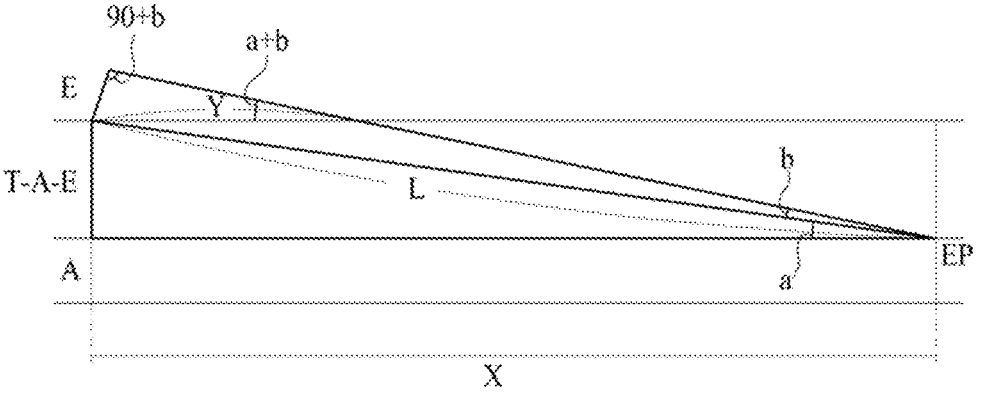
FIG. 10 is a diagram for describing a projection height E of the 3D stereoeffect sign 400 according to the fourth embodiment of the present invention.
Figure 11:
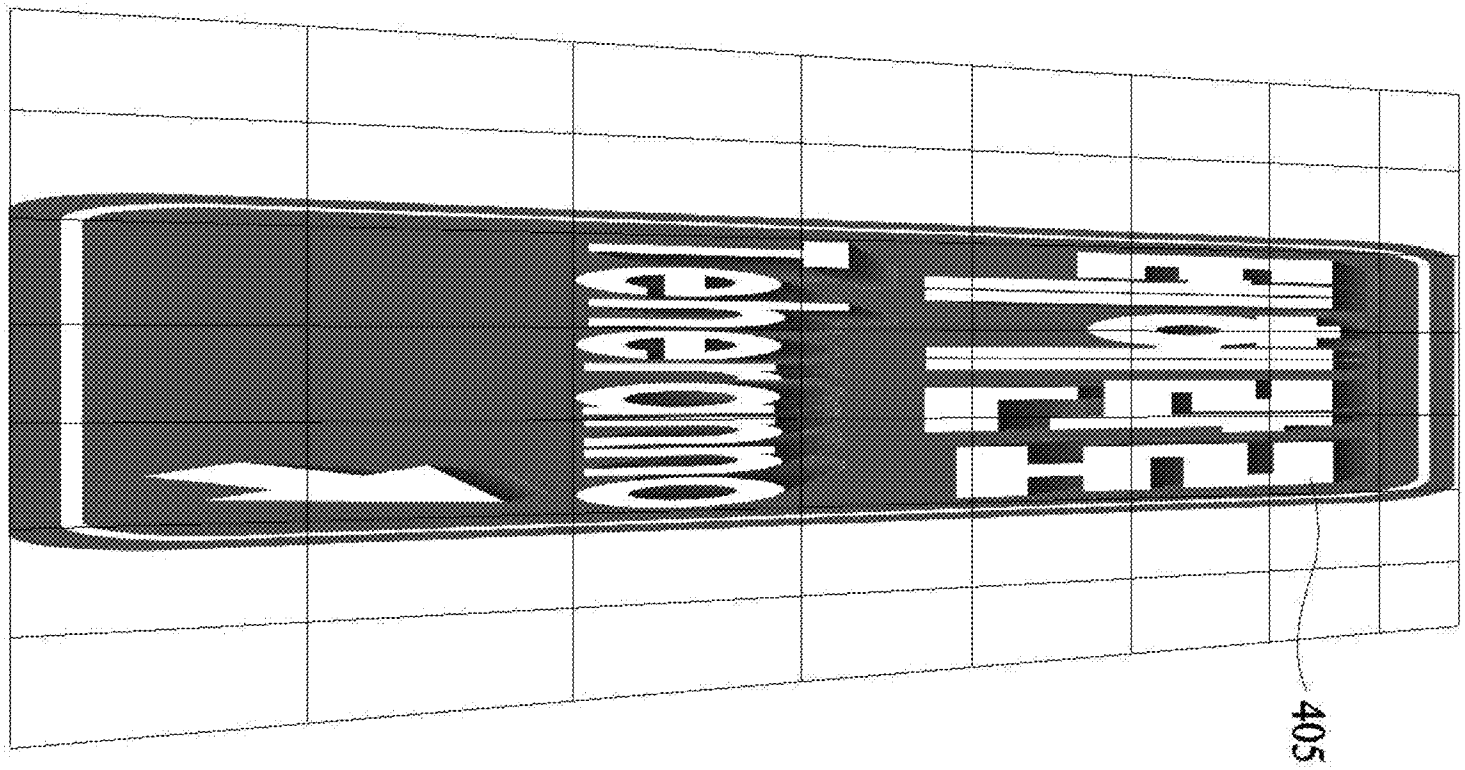
FIG. 11 is a plan view illustrating a printed example of the 3D stereoeffect sign 400 according to the fourth embodiment of the present invention.

FIG. 10 is a diagram for describing a projection height E of the 3D stereoeffect sign 400 according to the fourth embodiment of the present invention. Referring to FIG. 10, a sight height A of the viewer, a height T of a tunnel 41, a reference distance X between the viewer and the sign 400, a distance L between the eyes of the viewer and the sign 400, an angle a formed between the far side of the sign 400 and the eyes of the viewer, an angle a+b formed between the near side of the sign 400 and the eyes of the viewer, and a printed length Y of the sign are illustrated.

Through FIG. 10, a relationship among A, T, X, and Y is derived as Equation 4.

$$L=\sqrt{(X^2+(T-A-E)^2)}$$

$$b=\tan^{-1}(E/L),\ E=L\cdot\tan(b)$$

$$\tan(b)=E/L$$

$$a=\tan^{-1}((T-A-E)/X),\ X=(T-A-E)/\tan(a)$$

$$\tan(a)=(T-A-E)/X$$

$$E/(\sin(a+b))=Y/(\sin(90-b))\text{[Equation 4]}$$

As seen through Equation 4, the printed length Y needs to be increased as the reference distance X between the viewer and the sign is increased.

The printed width is the same as that of the method of calculating the printed width according to the first embodiment of the present invention.

In the sign 400 according to the fourth embodiment of the present invention, an upper portion of a character 405 is provided at the near side. The far side of the sign 400 provided above the viewer 40 comes down as the viewer 40 gradually approaches. This is different from the case where the upper portion of the character 105 of the sign 100 according to the first embodiment of the present invention is provided at the far side.

When the 3D stereoeffect sign according to the embodiments of the present invention is viewed by the viewer 40 located farther than the reference distance X, the sign is recognized to be attached on the surface, and as the viewer 40 is gradually close to the sign from the reference distance X, the sign is recognized in a form of vertically protrude. In addition, as the viewer is closer to the sign via the reference distance X, the sign is recognized to be attached on the surface again.

As described above, the 3D stereoeffect sign 100 is felt to move in a lively manner so that the sign vertically protrudes according to the movement of the viewer, thereby improving visibility and awakening the awareness. Further, the effect of being projected in a protruding form prevents overspeeding or drowsiness of the driver.

Figure 12:
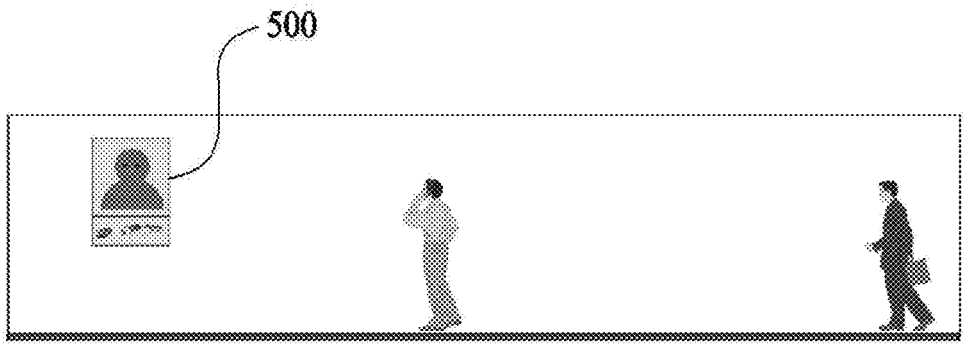
FIG. 12 is a diagram illustrating an election poster using a 3D stereoeffect sign 500 according to a fifth embodiment of the present invention.
Figure 12:
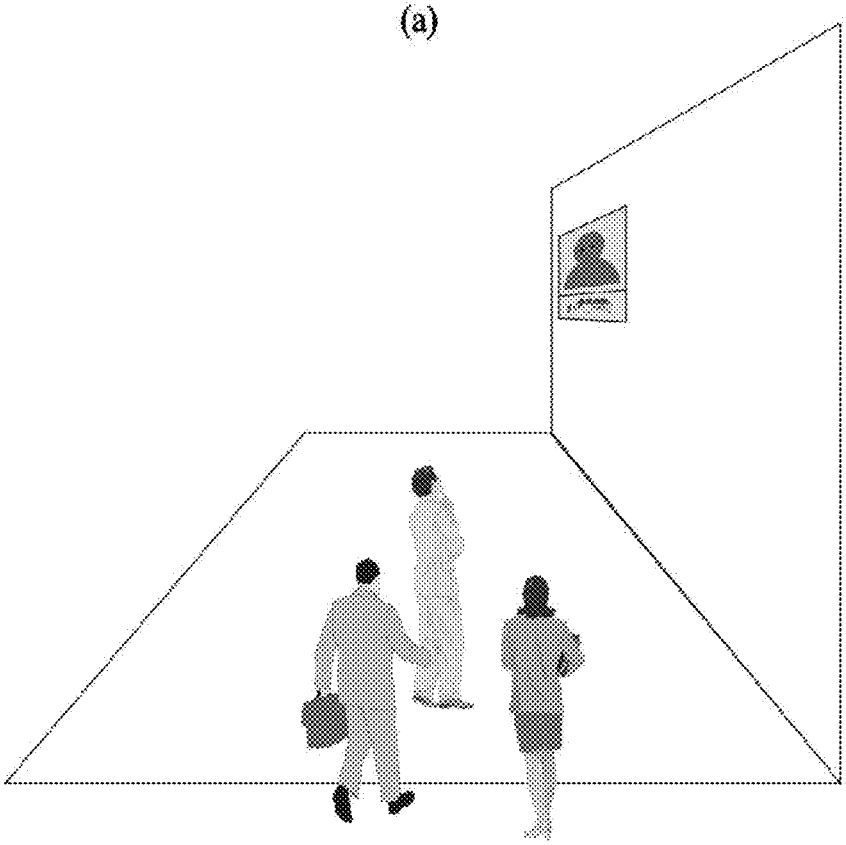

FIG. 12 is a diagram illustrating an election poster using a 3D stereoeffect sign 500 according to a fifth embodiment of the present invention. FIG. 12A is a front view of the election poster and FIG. 12B illustrates the election poster which is projected to the eyes of the viewer at an angle where the viewer is located. As illustrated in FIG. 12, when the sign is applied to the election poster, a symbol or a name is stereoscopically viewed when the viewer passes through the distance, thereby concentrating an interest.

Figure 13:
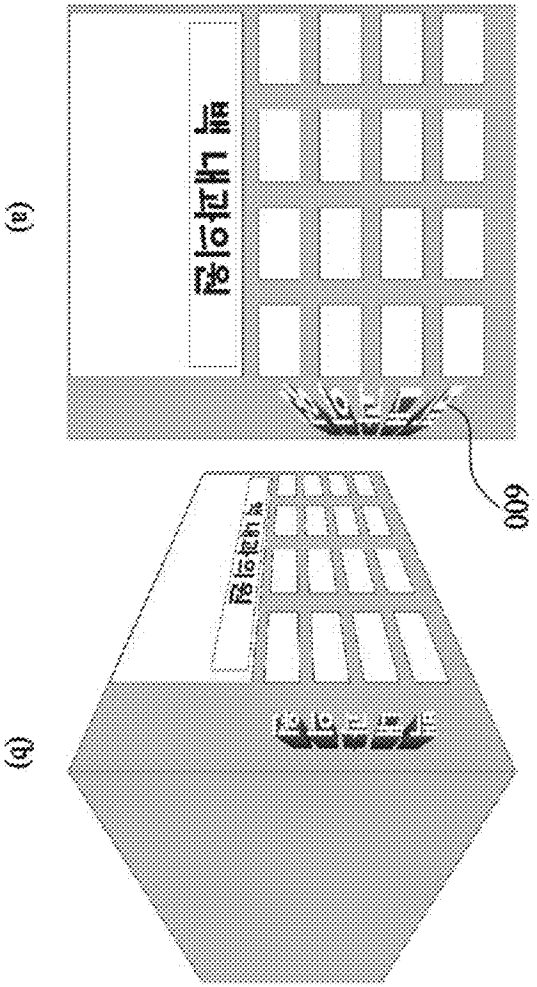
FIG. 13 is a diagram illustrating a sign poster using a 3D stereoeffect sign 600 according to a sixth embodiment of the present invention.

FIG. 13 is a diagram illustrating a sign poster using a 3D stereoeffect sign 600 according to a sixth embodiment of the present invention. FIG. 13A is a front view of a building attached with a sign poster and FIG. 13B is a perspective view of a building which is projected to the eyes of the viewer. As illustrated in FIG. 13, when the viewer is located at the side of one surface by attaching the sign poster onto one surface of the building, the sign poster may be stereoscopically viewed by the eyes of the viewer.

Figure 14:
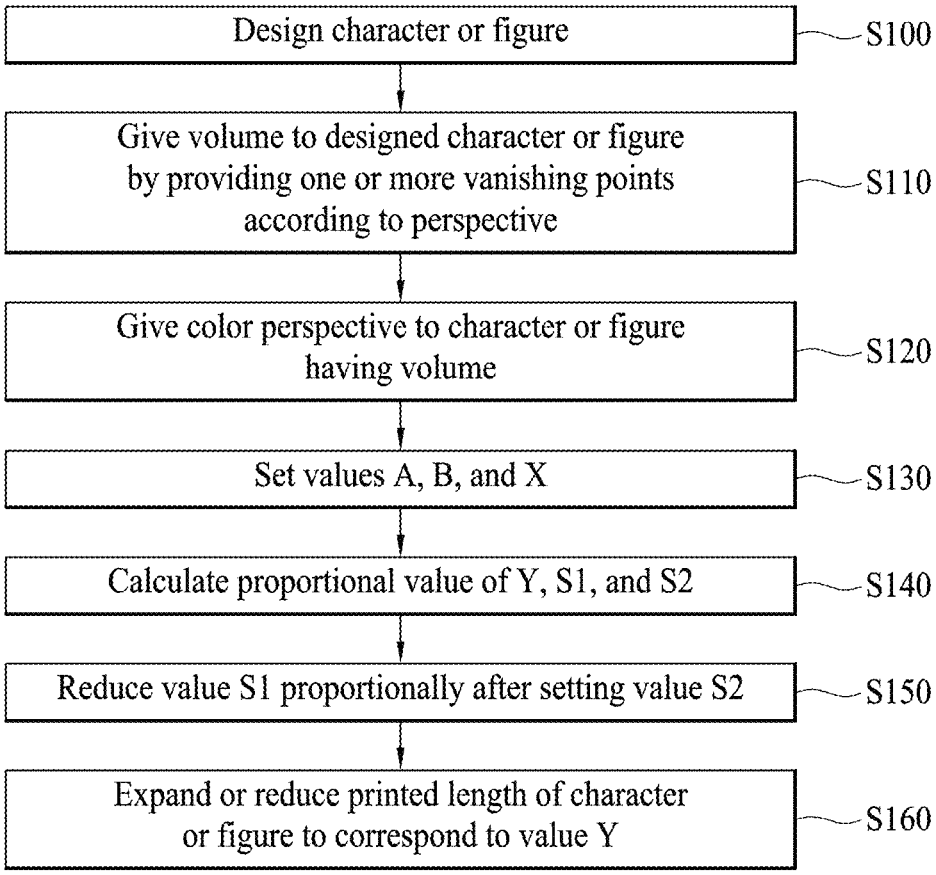
FIG. 14 is a flowchart illustrating a method of manufacturing a 3D stereoeffect sign according to an embodiment of the present invention.

A method of manufacturing the 3D stereoeffect sign is illustrated as a flowchart like FIG. 14.

Referring to FIG. 14, a character or a figure having specific information to be delivered is designed (S100, and one or more vanishing points are provided in the designed character or figure to give a volume according to a perspective (S110). One-point perspective is applied when one vanishing point is provided, two-point perspective is applied when two vanishing points are provided, three-point perspective is applied when three vanishing points are provided, and multi-point perspective is applied when three or more vanishing points are provided.

According to the giving of the volume, a color perspective is given to the character or the figure having the volume. As the color perspective is close to the vanishing points, the chroma may be lowered. Alternatively, as the color perspective is close to the vanishing points, the chroma may be thin and cloudy. Alternatively, a red color may be applied to a place close to the character or the letter and a blue color may be applied to a place close to the vanishing point.

A proportional value of Y, S1, and S2 is derived (S140) by setting values A, B, and X (S130), and a width of the character or the figure having the color perspective is adjusted to correspond to the S2 value, and then the S1 value is proportionally reduced (S150). In addition, the 3D stereoeffect sign according to the embodiments of the present invention is manufactured by a step of expanding or reducing (S160) a printed length of the character or the figure to correspond to the Y value.

Figure 15:
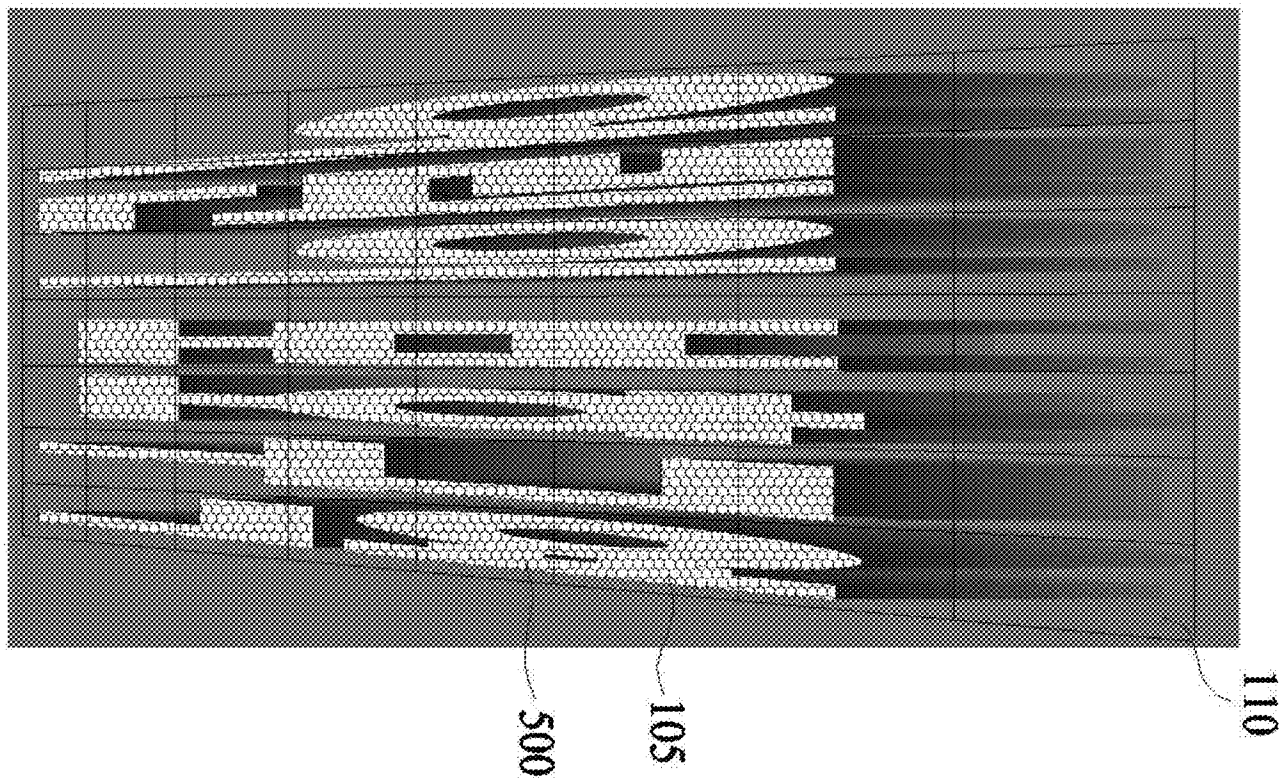
FIG. 15 is a diagram illustrating a non-slip packaging assembly 500 having the 3D stereoeffect sign according to the first embodiment of the present invention.

The 3D stereoeffect sign according to the embodiments of the present invention may be applied to a non-slip packaging assembly. Referring to FIG. 15, an unevenness having roughness is formed by the surface of the upper layer of the 3D stereoeffect sign 100 according to the first embodiment of the present invention to have a non-slip function. The non-slip packaging assembly 500 may be concrete blocks installed on the road, rubber materials, and tiles, and the like, and may be formed by grooving or tinning, and thus the present invention is not limited to the method or the material.

The 3D stereoeffect sign according to the embodiments of the present invention includes an adhesive to be a sticker.

As described above, the preferred embodiments of the present invention are described, and in addition to the embodiments described above, it will be apparent to those skilled in the art that the present invention may be embodied in other specific forms without departing from the spirit or the scope of the present invention. Therefore, the above-described embodiments are to be considered as illustrative rather than restrictive, and the present invention is not limited to the above description, but may be modified within the scope of the appended claims and equivalents thereof.

The invention claimed is:

1. A manufacturing method of a 3D stereoeffect sign, comprising: designing a figure or a character having specific information; giving a volume to the figure or the character by providing one or more vanishing points;

setting a projection height of the figure or the character having the volume which is projected to the eyes of a viewer which is located at a reference distance;

setting a printed length of the figure or the character having the volume to correspond to the projection height;

setting a printed width of the figure or the character having the volume; and adjusting the length and the width of the figure or the character having the volume proportionally to correspond to the printed length and the printed width, wherein the volume includes a color perspective in which chroma is lowered as the color perspective is close to the one or more vanishing points, wherein the 3D stereoeffect sign is applied on a curved road and provided on an oblique line of the sight of the viewer, the one or more vanishing points provided at both sides with respect to the oblique line, respectively.

2. A 3D stereoeffect sign manufactured by the manufacturing method of the 3D stereoeffect sign of claim 1.

3. A non-slip packaging assembly having the 3D stereoeffect sign of claim 2.

4. A sticker having the 3D stereoeffect sign of claim 2.

* * * * *